US006870511B2

(12) United States Patent
Lynch et al.

(10) Patent No.: US 6,870,511 B2
(45) Date of Patent: Mar. 22, 2005

(54) METHOD AND APPARATUS FOR MULTILAYER FREQUENCY SELECTIVE SURFACES

(75) Inventors: Jonathan J. Lynch, Oxnard, CA (US); Joseph S. Colburn, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/383,385

(22) Filed: Mar. 6, 2003

(65) Prior Publication Data

US 2003/0214456 A1 Nov. 20, 2003

Related U.S. Application Data

(60) Provisional application No. 60/381,098, filed on May 15, 2002.

(51) Int. Cl.[7] ..... H01Q 15/24
(52) U.S. Cl. ..... 343/767; 343/756
(58) Field of Search ..... 343/767, 756, 343/909

(56) References Cited

U.S. PATENT DOCUMENTS 4,477,815 A * 10/1984 Brunner et al. ..... 343/756
5,434,587 A 7/1995 Hannan ..... 343/909
5,689,276 A * 11/1997 Uematsu et al. ..... 343/872
6,396,451 B1 * 5/2002 Wu et al. ..... 343/756

OTHER PUBLICATIONS

Barlevy, A.S, et al., "On the Electrical and Numerical Properties of High *Q* Resonances in Frequency Selective Surfaces," *Progress in Electromagentics Research, PIER*, vol. 22, pp 1–27 (1999).

* cited by examiner

*Primary Examiner*—James Vannucci
(74) *Attorney, Agent, or Firm*—Ladas & Parry LLP

(57) ABSTRACT

A method for designing a multiple layer frequency selective surface structure. An overall response for the structure is specified. The desired response may be modeled as a filter response. Parameters for each of the layers making up the structure that provide the overall response are determined based on the polarization modes between the layers being decoupled. To provide for decoupling, the individual layers are rotated with respect to each other. The overall response of the structure is then calculated and compared to the desired response. Adjustments are made in the parameters of each layer until the calculated response is equal or nearly equal to the desired response.

43 Claims, 6 Drawing Sheets

METHOD AND APPARATUS FOR MULTILAYER FREQUENCY SELECTIVE SURFACES

CROSS-REFERENCE TO RELATED APPLICATIONS

This application is related to and claims benefit of U.S. Provisional Application No. 60/381,098 filed on May 15, 2002, which is incorporated herein by reference in its entirety.

BACKGROUND

1. Field

The present invention relates to frequency selective surfaces and, more particularly, to multiple layer frequency selective surfaces receiving electromagnetic radiation at oblique angles and performing electromagnetic conversion functions, such as polarization conversion, filtering, and frequency diplexing.

2. Description of Related Art

Frequency selective surfaces selectively pass electromagnetic radiation. An electromagnetic wave applied to a frequency selective surface (FSS) will be either passed through the surface or reflected off of the surface depending upon the electrical characteristics of the frequency selective surface and the frequency of the applied signal. A typical frequency selective surface comprises a doubly periodic array of identical conducting elements, or apertures in a conducting screen. Such a conventional surface is usually planar and formed by etching the array design from a metal clad dielectric substrate. These conventional frequency selective surfaces behave as filters with respect to incident electromagnetic waves with the particular frequency response being dependent on the array element type, the periodicity of the array and on the electrical properties and geometry of the surrounding dielectric and/or magnetic media. The periodicity is the distance between the centers of adjacent elements or between the centers of adjacent apertures.

One type of frequency selective surface known in the art comprises a continuous zigzag conductive grating supported on a thin dielectric sheet. Such a grating is typically known as a meander-line grating as in depicted in FIG. 1. In FIG. 1, the grating is shown as a parallel array 10 of meander line elements 14 oriented at 45 degrees from the horizontal and vertical. The meander-line grating can be designed to present specific inductive and capacitive susceptances to the TM and TE polarization of an electromagnetic wave incident on the grating. Hence, the meander-line grating can be used to control the polarization of an electromagnetic wave passing through the grating.

Many useful passive structures can be realized by using one or more frequency selective surfaces. Frequency diplexers, polarization converters, and filters can be realized by constructing multiple layer structures comprising layers of frequency selective surfaces spaced a certain distance apart (e.g., one-quarter wavelength of the operating frequency of the structure). A dielectric medium may be used to separate the frequency selective surfaces.

A general problem with multiple layer frequency selective surface structures lies in controlling the polarization mode coupling between the frequency selective surface layers. Most complex multiple layer structures are designed for normal incidence of electromagnetic radiation, since most applications require this. Such structures may be used with electromagnetic radiation at, or near, normal incidence, or, at most, within one or two planes of incidence, since the choice of polarization mode sets for multiple frequency selective surface layers that eliminate mode coupling is well-known in the art. Some multiple layer frequency selective surface structures have been shown to operate at up to 30 degrees off normal with the errors due to mode coupling effects limited to tolerable levels.

An example of a multiple layer frequency selective surface structure operable over a wide range of angles of incidence is disclosed by Hamman in U.S. Pat. No. 5,434,587, issued Jul. 18, 1995. Hamman describes a wide-angle polarizer comprising multiple layers of meander-line gratings. The meander-line gratings disclosed in Hamman are disposed parallel to each other, while the dielectric constants and thicknesses of the dielectric material surrounding and between the gratings are controlled to provide wide angle capability. However, wide-angle capability results in some deviation from perfect polarization conversion for any given oblique angle. Also, the polarization conversion capability of the Hamman device noticeably declines at large oblique angles of incidence, due to the inability to completely control polarization mode coupling.

Many applications, such as polarization converters for low profile satellite communication antennas, require performance optimization at oblique incident angles where polarization mode coupling may be strong. Hence, the particular advantages of specific individual complex frequency selective surfaces may be lost when combined into multiple layer structures, due to the mode coupling between layers.

It is therefore an object of this invention to provide multiple layer frequency selective surface structures operable at oblique incident angles by controlling mode coupling between layers of the structure. It is a further object of the present invention to select a suitable uncoupled mode set for each of the layers, and to provide a method of determining the orientation of each frequency selective surface with respect to the others to minimize coupling between the chosen polarization modes. In this way, the polarization conversion properties of the multilayer structure can be engineered to give the desired performance.

SUMMARY

Conversion of electromagnetic energy, such as polarization conversion, by structures comprising multiple layers of frequency selective surfaces may be improved by determining a suitable polarization mode set for the layers such that the modes are uncoupled (i.e. independent). According to the present invention, polarization mode independence may be achieved by rotating the layers by a specific amount with respect to the other layers. The amount of rotation required is based on the scattering properties of the layers and the polarization and incident angle of an electromagnetic wave incident on the structure.

One embodiment of the present invention provides a method for designing a multiple layer structure for transforming an electromagnetic signal having a specified polarization, the electromagnetic signal being directed through each layer of the multiple layer structure, and the method comprising the steps of: specifying a frequency for the electromagnetic signal and an angle of incidence of the electromagnetic signal on the multiple layer structure; providing a stacked plurality of frequency selective surface layers, a first layer being on top and one or more lower layers positioned beneath it, each layer having adjustable parameters to provide a desired transformation response and each lower layer having a rotational orientation with respect to a corresponding layer immediately above each lower layer, each layer transforming the electromagnetic signal as it passes through the layer; and adjusting the parameters and rotational orientation of at least one layer so that the chosen polarization modes of the electromagnetic signal do not couple as the electromagnetic signal passes from one layer to a next layer.

Another embodiment according to the present invention provides a multiple layer frequency selective structure comprising: an upper frequency selective surface layer receiving an electromagnetic signal, the upper frequency selective surface layer having a port I mode decoupling angle and a port II mode decoupling angle; and one or more lower frequency selective surface layers disposed beneath the upper frequency selective surface layer in a stacked configuration; each lower frequency selective surface layer having a port I mode decoupling angle and a port II mode decoupling angle; and each lower frequency selective surface layer having a layer rotational orientation to the layer immediately above the lower layer, wherein the layer rotational orientation of each lower layer being such that the port I mode decoupling angle of each lower layer is within a desired tolerance of the port II mode decoupling angle of the layer immediately above each lower layer.

Still another embodiment of the present invention provides a method for designing a multiple layer structure to obtain a desired response, the multiple layer structure having an upper frequency selective surface layer and one or more lower frequency selective surface layers, each lower layer having a rotational orientation with a corresponding layer immediately above each lower layer, and the method comprising the steps of: specifying a desired overall response for the multiple layer structure; specifying a scattering matrix for each layer; calculating a port I mode decoupling angle and a port II mode decoupling angle for each layer based on the scattering matrix for each layer; adjusting the rotational orientation of each lower layer so that the port I mode decoupling angle of each lower layer is within a desired tolerance of the port II mode decoupling angle of the corresponding layer immediately above each lower layer; calculating an overall response for the multiple layer structure; comparing the calculated overall response with the desired response; and repeating the steps described above until the calculated overall response is within a desired tolerance of the desired response. Another embodiment of the present invention provides a multiple layer frequency selective surface structure designed according to the method for designing described immediately above.

DETAILED DESCRIPTION

Embodiments of the present invention will now be described more fully hereinafter with reference to the accompanying drawings, in which preferred embodiments of the invention are shown. The present invention may be embodied in many different forms and should not be construed as limited to the embodiments set forth herein.

Figure 2A:
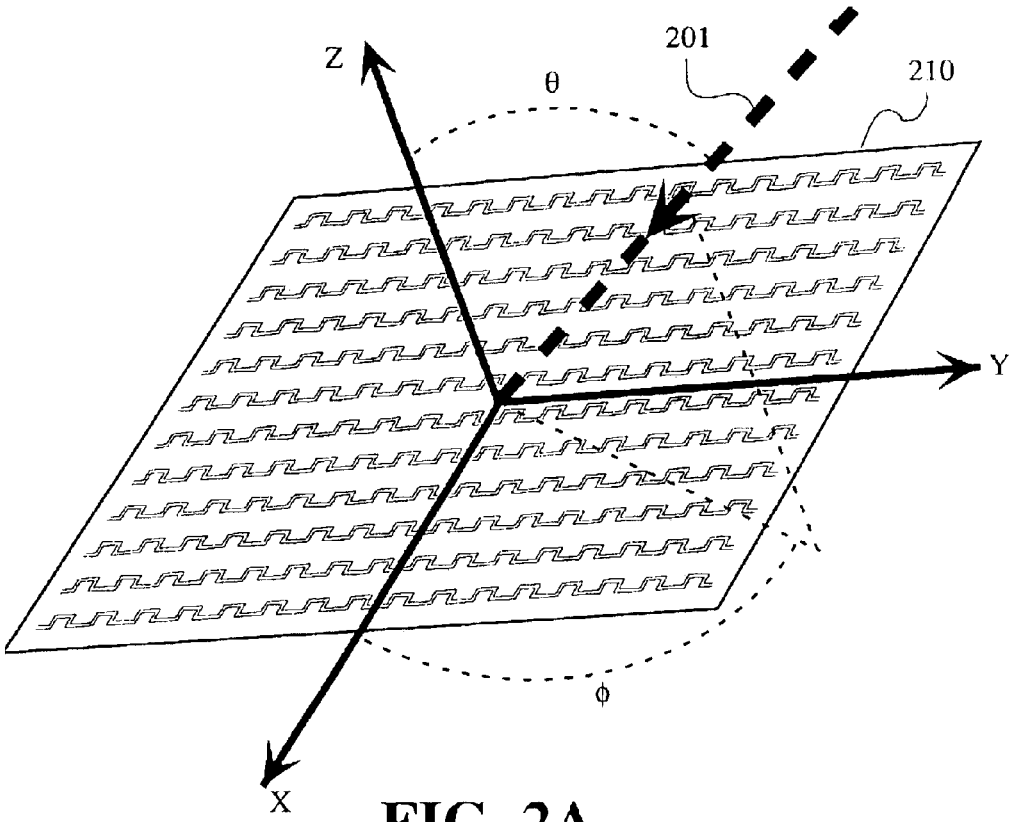
FIG. 2A depicts an electromagnetic wave incident on a frequency selective surface showing the polar angles defining the angle of incidence.

FIG. 2A shows an electromagnetic wave represented by a direction vector 201 incident on a frequency selective surface 210 with a three-dimensional XYZ axis superimposed on the frequency selective surface 210. The frequency selective surface 210 lies in the plane defined by the X-axis and the Y-axis and the Z axis projects perpendicularly to the X-Y plane. The angle of the direction vector 201 with respect to the XYZ axis is defined by two polar angles $\theta$, $\phi$. The angle $\phi$ defines the azimuth angle of the direction vector 210, that is, the angle from the X-axis when the direction vector 210 is projected into the X-Y plane. The angle $\theta$ defines the elevation angle of the direction vector, that is, the angle of the direction vector from the Z-axis.

The polarization of the electromagnetic wave incident on the frequency selective surface 210 is defined with reference to the frequency selective surface lying in the X-Y plane. Those skilled in the art understand that any other direction may be used to define polarization, but that choosing the incident electromagnetic wave polarization is sufficient to define the polarization and simplifies the analysis. The electromagnetic wave incident on the frequency selective surface can be decomposed into the incident wave phasor of the transverse magnetic polarization mode $a_{TM}$ and the incident wave phasor of the transverse electric polarization mode $a_{TE}$, where "TM" and "TE" refer to the transverse magnetic and electric polarization modes, respectively. With the polarization modes defined with respect to the frequency selective surface lying in the X-Y plane, the two most common polarization modes are the mode that is transverse magnetic to the z axis ($TM_z$) and the mode that is transverse electric to the z axis ($TE_z$).

The transmission of the transverse modes of the electromagnetic wave through the frequency selective surface can be described with the following complex matrix equation:

$$\begin{bmatrix} b_{TM} \\ b_{TE} \end{bmatrix} = \begin{bmatrix} T_{TMTM} & T_{TMTE} \\ T_{TETM} & T_{TETE} \end{bmatrix} \begin{bmatrix} a_{TM} \\ a_{TE} \end{bmatrix} = T \begin{bmatrix} a_{TM} \\ a_{TE} \end{bmatrix}$$

where $b_{TM}$ and $b_{TE}$ are the amplitudes of the electromagnetic wave after transformation by the frequency selective surface. The transmission matrix T describes the transformation of the electromagnetic wave by the frequency selective surface for a given angle of incidence and a given frequency. As is known in the art, the transmission matrix T depends upon the design of the frequency selective surface.

Figure 2B:
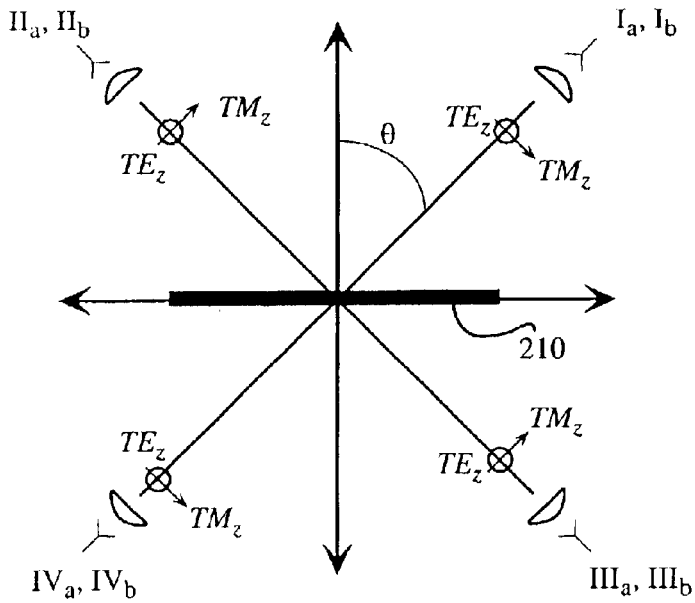
FIG. 2B depicts an eight port representation of the electromagnetic waves incident on the frequency selective surface depicted in FIG. 2A.

The transformation of electromagnetic waves provided by a frequency selective surface may also be described by a scattering matrix. The scattering of electromagnetic waves by a frequency selective surface may be found by modeling the frequency selective surface as an equivalent circuit having four pairs of ports, representing waves incident on the surface 210 from four different directions as shown in FIG. 2B. Each pair of ports corresponds to the two polarization modes, $TM_z$ and $TE_z$. Scattering from the frequency selective surface may then be represented by the following 8×8 matrix (where I is the identity matrix):

$$S = \begin{pmatrix} 0 & T^T - I & 0 & T^T \\ T - 1 & 0 & T & 0 \\ 0 & T^T & 0 & T^T - I \\ T & 0 & T - I & 0 \end{pmatrix}$$

Each element in the above matrix is the 2×2 submatrix describing TM and TE scattering for each pair of ports. As described above, the transmission matrix T describes the transformation of the electromagnetic wave by the frequency selective surface for a given angle of incidence and a given frequency. Note that the form of the matrix S is determined by a number of properties of the frequency selective surface. First, it is assumed that the periodicity is less than or equal to half of a free space wavelength so that higher order scattering modes are not generated by the surface. Thus, energy incident at port I does not couple back to port I or port III. Similar port isolation occurs between the other port pairs, and this results in the zero submatrices in S. Second, transmission from port I to IV is identical from port III to port II, since the incident waves for each case "see" the same structure. Hence, the submatrices $S_{IV,I}=S_{II,III}=T$, as indicated above. Third, the reciprocal nature of the fields gives a symmetric scattering matrix, thus $S_{III,II}=S_{I,IV}=T^T$. Lastly, the submatrices that describe scattering from the surface (as opposed to transmission through) have the form T–I or $T^T$–I, which is a result of the shunt nature of a frequency selective surface.

The $TM_z/TE_z$ representation of the incident electromagnetic wave may be generalized to include modal decompositions with respect to an arbitrary direction in the X-Y plane, denoted by the unit vector $\hat{\alpha}_c=\cos(\gamma)\hat{\alpha}_x+\sin(\gamma)\hat{\alpha}_y$ making an angle γ with respect to the X axis. The angle γ may be referred to as the mode decoupling angle. This representation allows the choice of a mode set such that the transverse electric field or the transverse magnetic field in the direction $\hat{\alpha}_c$ vanishes for each mode. The matrix that transforms the $TM_c/TE_c$ representation of the electromagnetic wave to the $TM_z/TE_z$ may be shown as follows:

$$\begin{pmatrix} a_{TM_z} \\ a_{TE_z} \end{pmatrix} = U_{zc} \begin{pmatrix} a_{TM_c} \\ a_{TE_c} \end{pmatrix}$$

where $$U_{zc} = \frac{1}{\sqrt{1 - \sin^2(\theta)\cos^2(\phi - \gamma)}} \begin{pmatrix} \cos(\theta)\cos(\phi - \gamma) & \sin(\phi - \gamma) \\ -\sin(\phi - \gamma) & \cos(\theta)\cos(\phi - \gamma) \end{pmatrix}$$

The incident waves of the eight port representation of the frequency selective surface can be transformed to another mode set using the following matrix:

$$a_z = \begin{pmatrix} U_1 & 0 & 0 & 0 \\ 0 & U_2 & 0 & 0 \\ 0 & 0 & U_1 & 0 \\ 0 & 0 & 0 & U_2 \end{pmatrix} a_c$$

Note that each matrix element is a 2×2 submatrix. The transformations for ports I and III and for ports II and IV are identical since the frequency selective surface appears identical for these angles of incidence. In this description, unitary submatrix $U_1$ will be referred to as the port I transformation matrix and unitary submatrix $U_2$ will be referred to as the port II transformation matrix.

Port I and port II transformation angles $\zeta_{1,2}$ defining mode independence for a given incident azimuth angle φ can be found by forming the matrix H=2T–I (where I is the identity matrix). H is a unitary matrix if the frequency selective surface is treated as a lossless structure. Finding the parameters that provide for decoupling the polarization modes of the frequency selective surfaces may be performed by finding the real, unitary transformation matrices $U_1$ and $U_2$ that diagonalize the matrix H=2T–I as follows:

$$\Lambda = \begin{pmatrix} \lambda_1 & 0 \\ 0 & \lambda_2 \end{pmatrix} = U_2^T H U_1$$

Expressing the transformation matrices as:

$$U_1 = \begin{pmatrix} \cos\zeta_1 & -\sin\zeta_1 \\ \sin\zeta_1 & \cos\zeta_1 \end{pmatrix}$$

$$U_2 = \begin{pmatrix} \cos\zeta_2 & -\sin\zeta_2 \\ \sin\zeta_2 & \cos\zeta_2 \end{pmatrix}$$

the parameters $\lambda_1$, $\lambda_2$, $\zeta_1$ and $\zeta_2$ can then be calculated from the matrix H as follows:

$$\lambda_e \cos(\zeta_2-\zeta_1)=\tfrac{1}{2}(H_{11}+H_{22})$$
$$\lambda_e \sin(\zeta_2-\zeta_1)=\tfrac{1}{2}(H_{12}-H_{21})$$
$$\lambda_o \cos(\zeta_2+\zeta_1)=\tfrac{1}{2}(H_{11}-H_{22})$$
$$\lambda_o \sin(\zeta_2+\zeta_1)=\tfrac{1}{2}(H_{12}+H_{21})$$

where $$\lambda_e = \frac{1}{2}(\lambda_1 + \lambda_2) \text{ and } \lambda_o = \frac{1}{2}(\lambda_1 - \lambda_2).$$

The transformation angles $\zeta_{1,2}$ are real and the eigenvalues $\lambda_1$, $\lambda_2$ have unity magnitudes due to the unitary nature of matrix H.

A port I mode decoupling angle $\gamma_1$ for the frequency selective structure may be determined by equating the port I transformation matrix $U_1$ to the mode decoupling transformation matrix $U_{zc}$ as shown below:

$$\begin{pmatrix} \cos\zeta_1 & -\sin\zeta_1 \\ \sin\zeta_1 & \cos\zeta_1 \end{pmatrix} = \frac{1}{\sqrt{1-\sin^2(\theta)\cos^2(\phi-\gamma_1)}} \begin{pmatrix} \cos(\theta)\cos(\phi-\gamma_1) & \sin(\phi-\gamma_1) \\ -\sin(\phi-\gamma_1) & \cos(\theta)\cos(\phi-\gamma_1) \end{pmatrix}$$

Similarly, a port II mode decoupling angle $\gamma_2$ for the frequency selective structure may be determined by equating the port II transformation matrix $U_2$ to the mode decoupling transformation matrix $U_{zc}$ as shown below:

$$\begin{pmatrix} \cos\zeta_2 & -\sin\zeta_2 \\ \sin\zeta_2 & \cos\zeta_2 \end{pmatrix} = \frac{1}{\sqrt{1-\sin^2(\theta)\cos^2(\phi-\gamma_2)}} \begin{pmatrix} \cos(\theta)\cos(\phi-\gamma_2) & \sin(\phi-\gamma_2) \\ -\sin(\phi-\gamma_2) & \cos(\theta)\cos(\phi-\gamma_2) \end{pmatrix}$$

According to the present invention, independence of the chosen mode set throughout a multiple layer frequency selective structure is achieved by equating the port II transformation matrix of a preceding layer to the port I transformation matrix of a following, adjacent layer, that is $$U_2^{preceding} = U_1^{following}.$$

Hence, to ensure that polarization modes do not couple through the multiple layer frequency selective surface structure, the port I transformation angle $\zeta_1$ for one layer is made equal or nearly equal to the port II transformation angle $\zeta_2$ of the layer immediately preceding it. For the first layer of the structure, the port I transformation angle $\zeta_1$ is not constrained by the other layers, but the port II transformation angle $\zeta_2$ should match or nearly match the port I transformation angle $\zeta_1$ for the second layer. The port II transformation angle $\zeta_2$ for the second layer should match or nearly match the port I transformation angle $\zeta_1$ for the third layer and so forth. The port II transformation angle $\zeta_2$ for the last layer is not constrained by the other layers. Since the port I transformation angle $\zeta_1$ for the first layer and the port II transformation angle $\zeta_2$ for the last layer are not constrained by the other layers, these transformation angles may be chosen to give a desired polarization conversion from the input of the structure to the output.

Note also that since the mode decoupling angles $\gamma_{1,2}$ may be derived from the transformation angles $\zeta_{1,2}$, the necessary equality may be stated in terms of the mode decoupling angles. That is, the port II mode decoupling angle $\gamma_2$ of a layer should be equal or nearly equal to the port I mode decoupling angle $\gamma_1$ of the layer immediately preceding it in a multiple layer frequency selective surface structure.

If the frequency selective surface has a periodic pattern that is invariant under 180 degree rotation about the Z axis, the transmission matrix T is symmetric and the port I transformation matrix $U_1$ is equal to the port II transformation matrix $U_2$. Therefore, for surfaces that are invariant under 180 degree rotation, the port I and port II transformation angles $\zeta_{1,2}$ are equal as well as the port I and port II mode decoupling angles $\gamma_{1,2}$. In a structure comprising frequency selective surface layers that are all 180 degree invariant, the transformation matrices and, therefore, the mode decoupling angles, for each of the layers should be equal or nearly equal to achieve uncoupled polarization modes.

The requirements for matching or nearly matching the port I transformation matrix to the port II transformation matrix of an immediately preceding layer may be obtained by adjusting the azimuthal angle of incidence $\phi$ for the layer. Adjusting the azimuthal angle of incidence for the layers in a multiple layer structure may be achieved by rotating each layer with respect to the other layers in the structure.

Since the transformation angles $\zeta_{1,2}$ may change significantly for different azimuthal angles of incidence, it is preferable that the design of each of the frequency selective surfaces in the multiple layer structure be derived from using an electromagnetic simulation program. The parameters of the frequency selective surface, including its rotational orientation with respect to adjacent layers, can then be adjusted to achieve equality or near equality of mode decoupling angles in accordance with the present invention. If each of the frequency selective surface layers is configured to be invariant under 180 degree rotation, the design procedure is simplified since the port I and port II mode decoupling angles are the same for each layer.

Figure 3A:
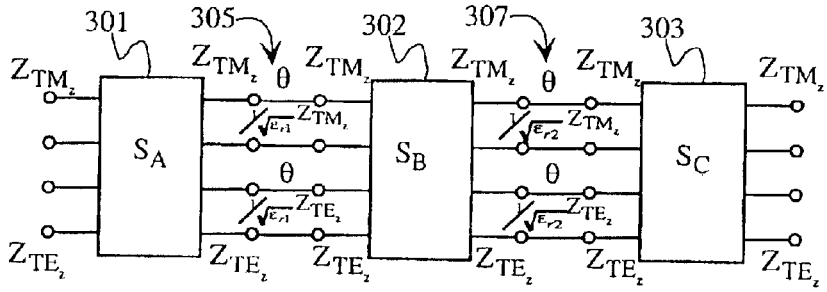
FIG. 3A shows a block diagram modeling the electrical characteristics of a multiple layer frequency selective surface.

The electrical characteristics of a multiple layer FFS structure can be modeled as an electrical network as shown in FIG. 3A. In FIG. 3A, the $TM_z/TE_z$ scattering for each frequency selective surface in a three layer structure is represented by three scattering matrices shown as three four port equivalent circuits 301, 302, 303. If the polarization modes between the layers are decoupled, the equivalent circuits between the layers can be modeled by transmission line sections 305, 307 comprising a pair of transmission lines, which have identical electrical lengths, for the two polarization modes $TM_z$, $TE_z$. In FIG. 3A, it is assumed that the medium between any one pair of layers is homogeneous, but the medium may vary from one pair of layers to the next.

Figure 3B:
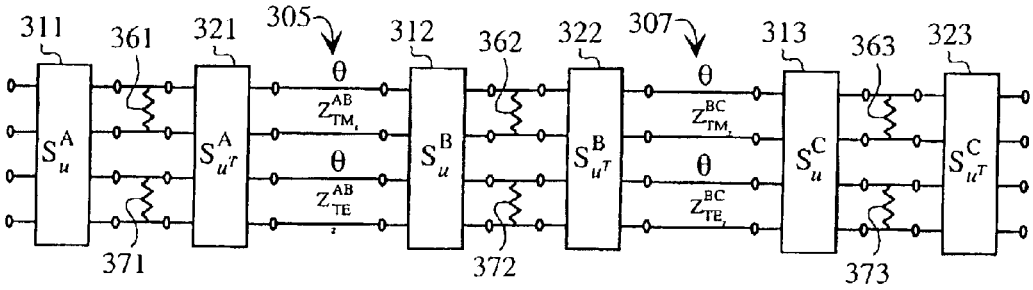
FIG. 3B shows the network depicted in FIG. 3A expanded into separate scattering matrices and transformation matrices.
Figure 3C:
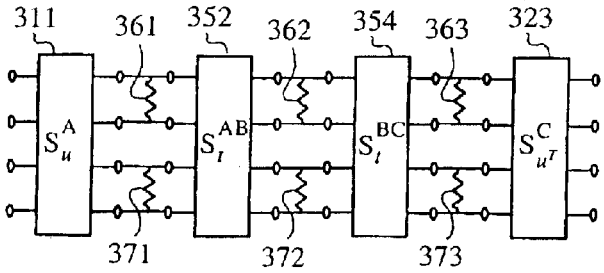
FIG. 3C shows a simplified form of the network depicted in FIG. 3B.

The scattering matrices shown in FIG. 3A can be represented as decoupled scattering matrices 311, 312, 313 decoupled with transformation matrices 321, 322, 323 and linked by shunt susceptances 361, 362, 363, 371, 372, 373, as shown in FIG. 3B. Choosing the proper transformation matrices diagonalizes the four port scattering matrix for each layer, resulting in an equivalent circuit consisting of two shunt susceptances. The resulting circuit can be further simplified by combining each set of transmission line sections 305, 307 with the two transformation networks, 321, 312 and 322, 313, directly adjacent, as shown in FIG. 3C, to arrive at a new set of transformation matrices 352, 354. If the frequency selective surfaces contain a pattern that is invariant under 180 rotation, completely uncoupled polarization modes between adjacent layers is achieved if all of the transformation matrices 352, 354 are identical. Otherwise, the transformation matrices 352, 354 must ensure that the port II mode decoupling angle of the first layer matches the port I mode decoupling angle of the second layer and the port II mode decoupling angle of the second layer matches the port I mode decoupling angle of the third layer to obtain completely uncoupled polarization modes between adjacent layers. If uncoupled modes are achieved, the equivalent circuit for a multiple layer FSS structure can be modeled as shown in FIG. 3D.

Figure 3D:
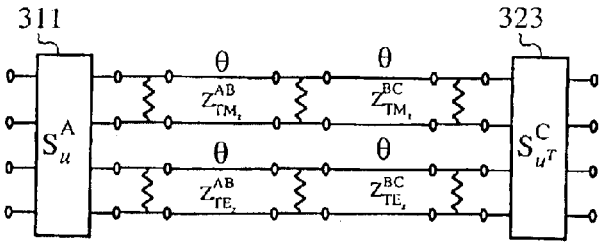
FIG. 3D shows the equivalent circuit obtained for a multiple layer frequency selective surface structure when the polarization modes are uncoupled.

Hence, by uncoupling the polarization components through careful selection of the parameters for each layer in a multiple layer FSS structure, a simple equivalent circuit results, as shown in FIG. 3D. The two circuits that lie between the transformation networks 311, 323 act as band-pass filters, one for each polarization component, whose responses are engineered using standard techniques. Hence, maintaining polarization mode independence throughout the entire multiple layer FSS structure leads to a simple equivalent circuit whose performance can be optimized in a straightforward manner.

According to an embodiment of present invention, for a multiple layer structure with an arbitrary number of frequency selective surface layers, one first determines the overall response of the multiple layer structure. As described above, the desired response may be modeled as a desired filter response. Susceptance values and transmission line lengths that give the desired filter response may be determined using filter theory. The parameters of the individual frequency selective surfaces are then calculated to give the desired susceptance values and the overall response of the multiple layer structure. If the frequency selective surface layers comprise meander line surfaces, the size and shape of the unit cell of the meander lines are adjusted to achieve the susceptance values, and the angle of incidence of each layer is adjusted to achieve the overall response. Since the parameters are interdependent, multiple iterations may be required to achieve the desired results. Generally, different angles of incidence will be required for each layer, which can be achieved by rotating the layers with respect to each other.

Figure 4A:
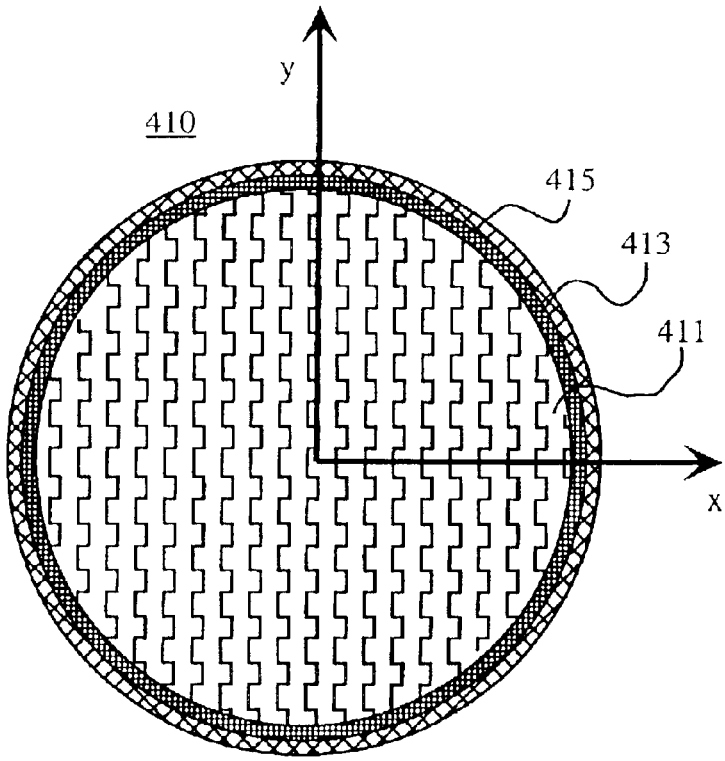
FIG. 4A shows a top view of a three layer meander line polarizer according to an embodiment of the present invention.
Figure 4B:
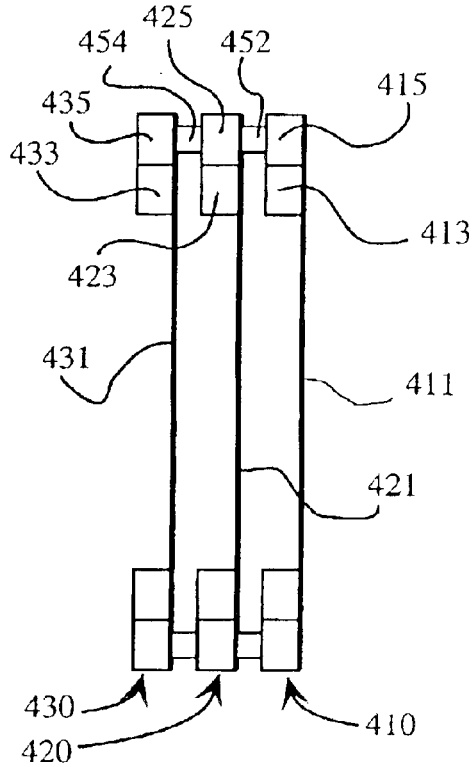
FIG. 4B shows a side view of the three layer meander line polarizer depicted in FIG. 4A.
Figure 5:
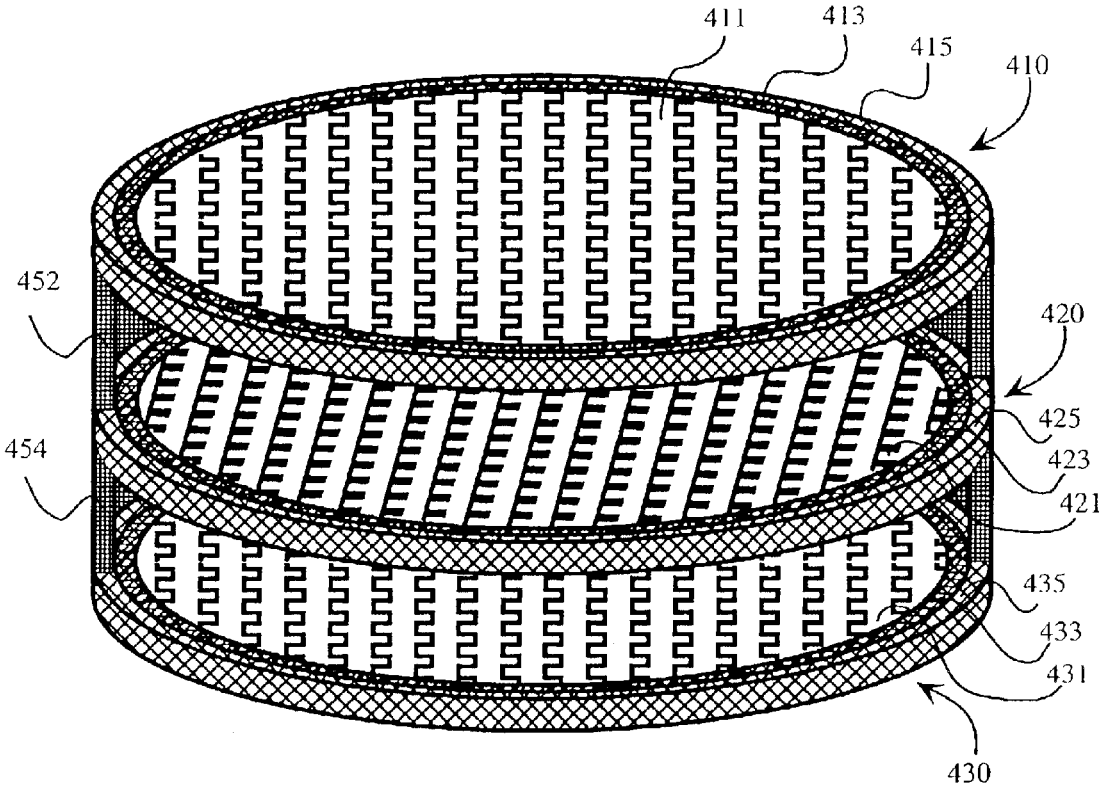
FIG. 5 show a perspective view of the three layer meander line polarizer depicted in FIGS. 4A and 4B, with portions of the spacers separating the layers removed to show the angular orientation of the layers to each other.

FIGS. 4A, 4B, and 5 show an example of a three layer frequency selective surface (FSS) structure 400 according to an embodiment of the present invention. The exemplary structure 400 converts electromagnetic radiation from circular polarization to linear polarization. FIG. 4A shows a plan view of the FSS structure 400, showing the top layer 410 of the structure. FIG. 4B is a side cross-sectional view of the structure 400, showing the three layers 410, 420, 430 of the structure. FIG. 5 shows a perspective view of the structure 400, highlighting the angular offset between the meander line patterns of the middle layer 420 and the top and bottom layers 410, 430, as described below.

The exemplary FSS structure 400 is designed for operation at 11.81 GHz and the angle of incidence of the incident electromagnetic radiation is $\theta=45°$ and $\phi=33°$ (with respect to the outer layers 410, 430). In the FSS structure 400, each layer may be constructed from a frequency selective surface sheet 411, 421, 431 placed between an outer concentric ring 415, 425, 435 and an inner concentric ring 413, 423, 433. The frequency selective surfaces sheets 411, 421, 431 may be fabricated by etching ½ oz. copper metal patterns on 2 mil thick polyimide sheets. The sheets 411, 421, 431 are pulled taught through the concentric rings 413, 415, 423, 425, 433, 435, radially outward, and held in place by the rings 413, 415, 423, 425, 433, 435 so that enough tension exists for mechanical rigidity. Preferably, the concentric rings 413, 415, 423, 425, 433, 435 are made of aluminum. Spacers 452, 454 are used to provide precision spacing between the layers 410, 420, 430. In the exemplary FSS structure 400, the layers 410, 420, 430 are spaced apart by 0.353 inches (0.897 cm).

Figure 6A:
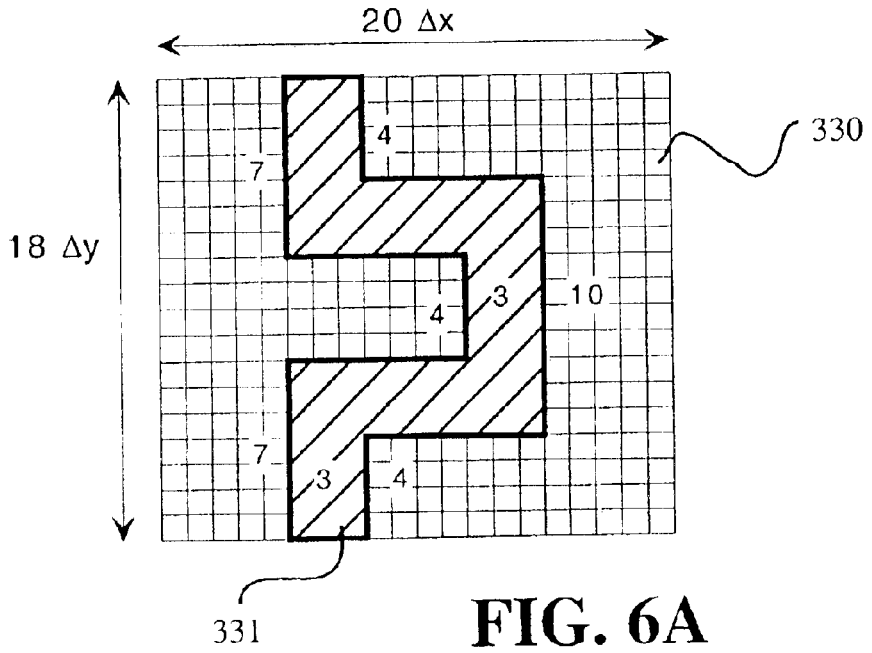
FIG. 6A shows the unit cell design for one meander line pattern used in the polarizer depicted in FIGS. 4A, 4B and 5.
Figure 6B:
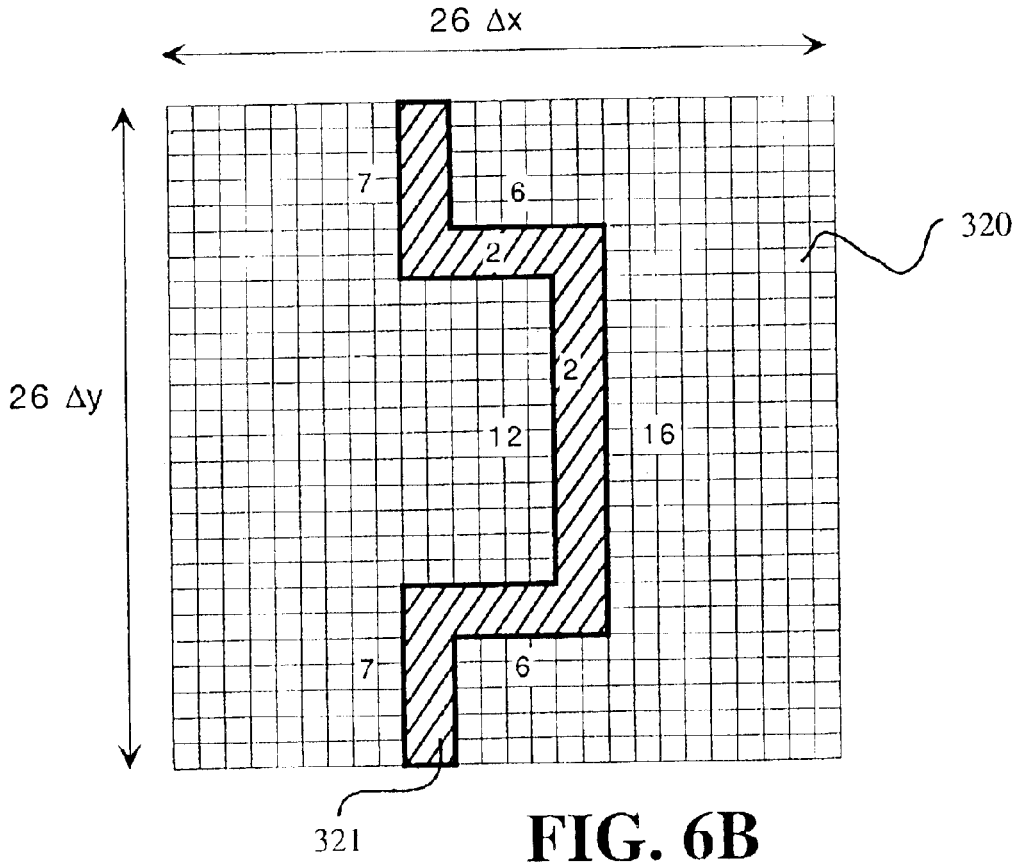
FIG. 6B shows the unit cell design for another meander line pattern used in the polarizer depicted in FIGS. 4A, 4B, and 5.

The exemplary FSS structure 400 uses two different meander line metal patterns, pattern A and pattern B, and the patterns are stacked in layers with the sequence BAB. Hence, both the top layer 410 and the bottom layer 430 use the pattern B and the middle layer 420 uses the pattern A. The unit cell design for pattern A is shown in FIG. 6A and the unit cell design for pattern B is shown in FIG. 6B. In FIG. 6A, pattern A, shown by strip 331, is based on a rectangular grid 330 that extends for 18 discrete units $\Delta y$ in the "y" direction and 20 discrete units $\Delta x$ in the "x" direction, where $\Delta y=24.4$ mils and $\Delta x=22.0$ mils. In FIG. 6B, pattern B, shown by strip 321, is based on a rectangular grid 320 that extends for 26 discrete units $\Delta x$ in the "x" direction and 26 discrete units $\Delta y$ in the "y"direction, where $\Delta x=\Delta y=20.78$ mils.

Using the method described above, it was found that rotation of the center layer 420 by 5 degrees with respect to the outer layers 410, 430, provides the decreased polarization mode coupling and improved performance at the angle of incidence described above. Specifically, the performance of the exemplary FSS structure 400 described above, was simulated using the Method of Moments. The FSS sheets 411, 421, 431 in the layers 410, 420, 430 were assumed to be infinitesimally thin and the electromagnetic effects of the polyimide were ignored. The resulting axial ratio was calculated to be 0.013 dB, indicating nearly perfect performance. The simulation was also performed without the 5 degree rotation in the center layer 420, and the resulting axial ratio degraded to 1.07 dB.

An embodiment of a four layer meander line polarizer according to the present invention for converting linear to circular polarization has been designed and fabricated. The four layer structure was designed to operate on a 12.45 GHz signal incident on the structure at angles of $\theta=45°$ and $\phi=68°$.

In the four layer design, each FSS layer is fabricated by etching a metal pattern on a 2 mil thick polyimide sheet coated with ½ oz copper. The sheets are placed between two concentric aluminum rings, 30 inches (76.2 cm) in diameter. Precision spacers are used between each of the layers to provide spacing between the sheets of 0.94 cm (0.370 inches).

Figure 1:
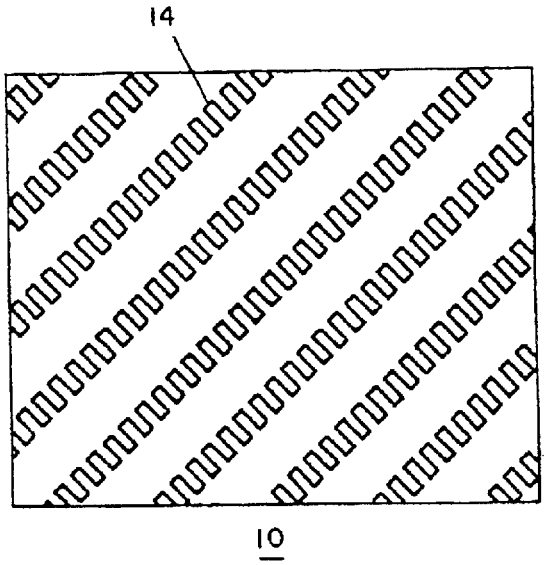
FIG. 1 (Prior Art)
FIG. 1 (prior art) shows a typical meander line grating.
Figure 7:
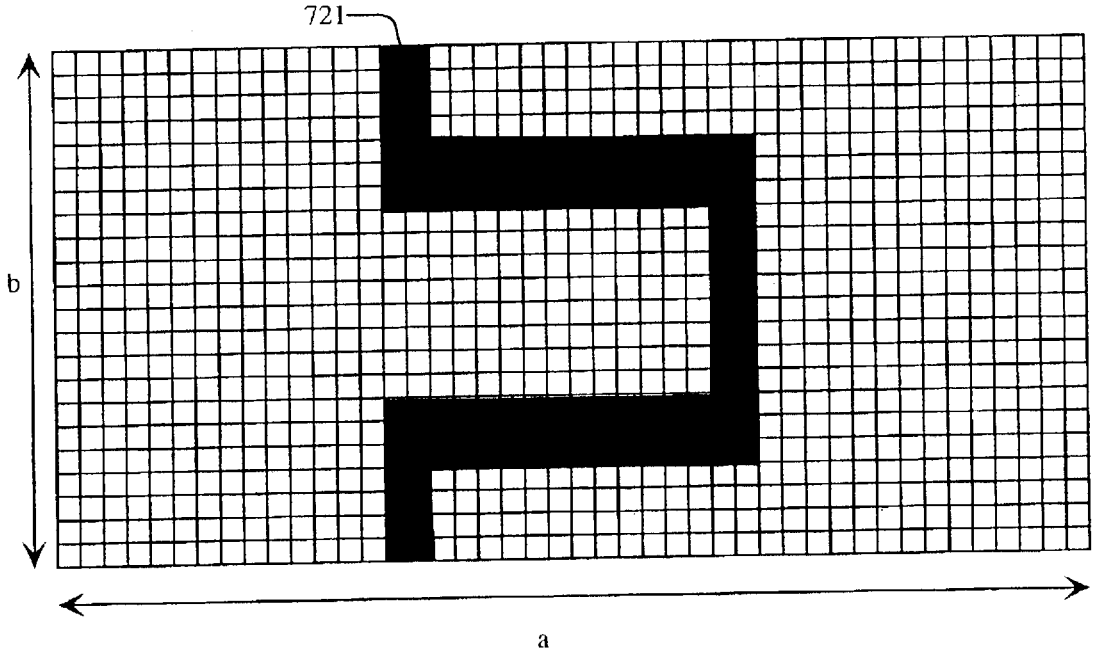
FIG. 7 shows a unit cell design for a meander line pattern used in an exemplary four layer embodiment of the present invention.

Two meander line patterns are used in the four layer design. A first pattern, pattern A is used on the two outside layers, and a second pattern, pattern B, is used in the inside layers. Hence, the layers are arranged ABBA. FIG. 7 shows a single period of the meander line pattern 721 on a rectangular grid having a width a and a height b. The same general meander line pattern is used for pattern A and pattern B, except that the patterns are based on a grid having different widths and heights. Pattern A has a width a=0.76 cm (0.30 inches) and a height b=1.07 cm (0.42 inches) and pattern B has a width a=0.13 cm (0.05 inches) and a height b=0.64 cm (0.25 inches).

To provide for polarization mode decoupling between the layers of the four layer design, the appropriate rotational orientation of the layers was calculated using the method described above. From the scattering properties of the frequency selective surfaces and the distances between the layers, rotational orientation angles were calculated. Optimal performance was calculated to occur with a rotational orientation angle $\phi=68°$ for the outer layers with pattern A and a rotational orientation angle $\phi=66°$ for the inner layers with pattern B. Hence, optimal performance is provided when the A layers are rotated about 2° with respect to the B layers.

The transmission parameters for the individual layers were measured and used to calculate the susceptances and transformation angles for the layers. For the layers with pattern A, a susceptance matrix of $$b = \begin{pmatrix} -.317 \\ .278 \end{pmatrix}$$

and a transformation angle $\zeta$=21.8° was calculated. For pattern B, a susceptance matrix of $$b = \begin{pmatrix} -.442 \\ .435 \end{pmatrix}$$

and a transformation angle of $\zeta$=20.7° was calculated. The overall transformation matrix T for the four layer design based on these values for the individual layers is shown below:

$$T = \begin{pmatrix} -1.01\text{dB}\angle 91.7^\circ & -6.83\text{dB}\angle 146.2^\circ \\ -6.86\text{dB}\angle 146.2^\circ & -1.04\text{dB}\angle 21.0^\circ \end{pmatrix}$$

At the desired incident angles of $\theta$=45° and $\phi$=68° for the electromagnetic signal, an axial ratio of 0.80 dB is obtained, and the phase shift between the two polarizations is very close to ninety degrees, as is required for circular polarization.

The overall performance of the four layer structure was then measured. The transmission matrix T of the of the four layer structure was measured to be:

$$T = \begin{pmatrix} -1.11\text{dB}\angle 92.3^\circ & -6.33\text{dB}\angle 147.3^\circ \\ -6.45\text{dB}\angle 146.4^\circ & -1.31\text{dB}\angle 21.3^\circ \end{pmatrix}$$

The at the desired incident angles shown above, the axial ratio is 0.29 dB, which is a better result that that anticipated by cascading the scattering parameters of the individually measured layers. This improvement in actual performance is probably due to measurement errors for the individual layers. Note again, however, that the design described above produces a circularly polarized output for the input polarization described by $\phi$=68°. Electromagnetic signals at different incident angles will produce different results.

Embodiments of the present invention may have frequency selective surface layers that comprise nearly any periodic metal pattern. However, the metal pattern is preferably electrically large, that is more that 5 wavelengths in extent of the received electromagnetic signal, and is preferably thin, such that the pattern has a thickness less than one twentieth of the period of the pattern. Also, the period of the pattern is preferably small enough so that only one Floquet mode propagates. A period of less than one-half the wavelength of the received electromagnetic signal ensures that this condition is met.

The present invention may accommodate multiple layer frequency selective surface structures with any number of layers, although those skilled in the art will appreciate that increasing the number of layers may increase the number of iterations required to determine optimal values for the design of the individual layers and the rotational angles between the layers. It will also be appreciated by those skilled in the art that the scattering properties for the individual layers are preferably calculated using simulation techniques known in the art, such as Method of Moments.

Fixed rotational orientations of the layers have been described above, but alternative embodiments of the present invention have layers in which the rotational orientations may be changed. The interlayer rotation angles may be changed based on the frequency or angle of incidence of a received electromagnetic signal. The interlayer rotations may also be changed based on desired changes in the overall performance of the multiple layer structure. The changeable interlayer rotation angles may be determined using the same methods described above for the fixed interlayer rotation angles.

From the foregoing description, it will be apparent that the present invention has a number of advantages, some of which have been described above, and others of which are inherent in the embodiments of the invention described herein. Also, it will be understood that modifications can be made to the apparatus and method described herein without departing from the teachings of subject matter described herein. As such, the invention is not to be limited to the described embodiments except as required by the appended claims.

What is claimed is:

1. A method for designing a multiple layer structure for transforming an electromagnetic signal having a specified polarization, the electromagnetic signal being directed through each layer of the multiple layer structure, and the method comprising the steps of:

(a) specifying a frequency for the electromagnetic signal and an angle of incidence of the electromagnetic signal on the multiple layer structure;

(b) providing a stacked plurality of frequency selective surface layers, a first layer being on top and one or more lower layers positioned beneath it, each layer having adjustable parameters to provide a desired transformation response and each lower layer having a rotational orientation with respect to a corresponding layer immediately above each lower layer, each layer transforming the electromagnetic signal as it passes through the layer; and (c) adjusting the parameters and rotational orientation of at least one layer so that a chosen set of polarization modes of the electromagnetic signal do not couple as the electromagnetic signal passes from one layer to a next layer.

2. The method of claim 1 wherein at least one frequency selective surface layer comprises a pattern that is invariant under 180 degree rotation.

3. The method of claim 1 wherein at least one frequency selective surface layer comprises a meander line surface.

4. The method of claim 3 wherein the meander line surface has a unit cell and adjusting the parameters in step (c) comprises adjusting the size and shape of the unit cell.

5. The method of claim 1 wherein step (c) comprises:

(c1) calculating a port I mode decoupling angle and a port II mode decoupling angle for each layer; and (c2) adjusting the rotational orientation of each lower layer so that the port II mode decoupling angle of each lower layer is within a specified percentage of the port I mode decoupling angle of the corresponding layer immediately above each lower layer.

6. The method of claim 1 wherein step (c) comprises:

(c1) calculating a port I transformation angle and a port II transformation angle for each layer; and (c2) adjusting the rotational orientation of each lower layer so that the port II transformation angle of each lower layer is within a specified tolerance of the port I transformation angle of the corresponding layer immediately above each lower layer.

7. The method of claim 1 wherein step (c) comprises:

(c1) calculating a port I transformation matrix and a port II transformation matrix for each layer; and (c2) adjusting the rotational orientation of each lower layer so that the port II transformation matrix of each lower layer is approximately equal to the port I transformation matrix of the corresponding layer immediately above each lower layer.

8. The method of claim 1 wherein a desired response is specified for the multiple layer structure and the method further comprises the steps of:

(d) calculating the overall response of the multiple layer structure from the parameters and rotational orientations of the layers of the multiple layer structure;

(e) comparing the desired response with the calculated overall response; and (f) repeating steps (c) through (e) if the desired response is not within a specified tolerance of the calculated overall response.

9. The method of claim 8 wherein step (c) comprises:

(c1) calculating a port I mode decoupling angle and a port II mode decoupling angle for each layer; and (c2) adjusting the rotational orientation of each lower layer so that the port II mode decoupling angle of each lower layer is within a specified percentage of the port I mode decoupling angle of the corresponding layer immediately above each lower layer.

10. The method of claim 8 wherein step (c) comprises:

(c1) calculating a port I transformation angle and a port II transformation angle for each layer; and (c2) adjusting the rotational orientation of each lower layer so that the port II transformation angle of each lower layer is within a specified tolerance of the port I transformation angle of the corresponding layer immediately above each lower layer.

11. The method of claim 8 wherein step (c) comprises:

(c1) calculating a port I transformation matrix and a port II transformation matrix for each layer; and (c2) adjusting the rotational orientation of each lower layer so that the port II transformation matrix of each lower layer is approximately equal to the port I transformation matrix of the corresponding layer immediately above each lower layer.

12. The method of claim 1, wherein at least one frequency selective surface layer comprises one or more periodic metal patterns.

13. The method of claim 12, wherein at least one metal pattern of the one or more periodic metal patterns has a length greater than five wavelengths of the electromagnetic signal.

14. The method of claim 12, wherein at least one metal pattern of the one or more periodic metal patterns has a thickness less than one-twentieth of the period of the at least one metal pattern.

15. The method of claim 12, wherein at least one metal pattern of the one or more periodic metal patterns has a period of less than one-half wavelength of the electromagnetic signal.

16. A multiple layer frequency selective structure comprising:

an upper frequency selective surface layer receiving an electromagnetic signal, the upper frequency selective surface layer having a port I mode decoupling angle and a port II mode decoupling angle; and one or more lower frequency selective surface layers disposed beneath the upper frequency selective surface layer in a stacked configuration; each lower frequency selective surface layer having a port I mode decoupling angle and a port II mode decoupling angle; and each lower frequency selective surface layer having a layer rotational orientation to the layer immediately above the lower layer, wherein the layer rotational orientation of each lower layer being such that the port I mode decoupling angle of each lower layer is within a desired tolerance of the port II mode decoupling angle of the layer immediately above each lower layer.

17. The multiple layer frequency selective structure of claim 16 wherein at least one frequency selective surface layer comprises a meander line surface.

18. The multiple layer frequency selective structure of claim 16, wherein one or more frequency selective surface layers comprise a polyimide sheet coated with copper with an etched meander line pattern.

19. The multiple layer frequency selective structure of claim 18, wherein the polyimide sheet is disposed between an inner concentric aluminum ring and an outer concentric aluminum ring.

20. The multiple layer frequency selective structure of claim 16, wherein each frequency selective surface layer comprises a polyimide sheet coated with copper with an etched meander line pattern, the polyimide sheet disposed between two concentric aluminum rings and the frequency selective surface layers being spaced apart by precision spacers.

21. The multiple layer frequency selective structure of claim 16, wherein at least one layer rotational orientation is changeable.

22. The multiple layer frequency selective structure of claim 16, wherein the port I mode decoupling angle of at least one frequency selective surface layer is equal to the port II mode decoupling angle of said at least one frequency selective surface layer.

23. The multiple layer frequency selective structure of claim 22 wherein the at least one frequency selective surface layer comprises a pattern that is invariant under 180 degree rotation.

24. The multiple layer frequency selective structure of claim 16, wherein at least one frequency selective surface layer comprises one or more periodic metal patterns.

25. The multiple layer frequency selective structure of claim 24, wherein at least one metal pattern of the one or more periodic metal patterns has a length greater than five wavelengths of the electromagnetic signal.

26. The multiple layer frequency selective structure of claim 24, wherein at least one metal pattern of the one or more periodic metal patterns has a thickness less than one-twentieth of the period of the at least one metal pattern.

27. The multiple layer frequency selective structure of claim 24, wherein at least one metal pattern of the one or more periodic metal patterns has a period of less than one-half wavelength of the electromagnetic signal.

28. A method for designing a multiple layer structure to obtain a desired response, the multiple layer structure having an upper frequency selective surface layer and one or more lower frequency selective surface layers, each lower layer having a rotational orientation with a corresponding layer immediately above each lower layer, and the method comprising the steps of:

(a) specifying a desired overall response for the multiple layer structure;

(b) specifying a scattering matrix for each layer;

(c) calculating a port I mode decoupling angle and a port II mode decoupling angle for each layer based on the scattering matrix for each layer;

(d) adjusting the rotational orientation of each lower layer so that the port I mode decoupling angle of each lower layer is within a desired tolerance of the port II mode decoupling angle of the corresponding layer immediately above each lower layer;

(e) calculating an overall response for the multiple layer structure;

(f) comparing the calculated overall response with the desired response; and (g) repeating steps (b) through (f) until the calculated overall response is within a desired tolerance of the desired response.

29. The method of claim 28 wherein the step of specifying a scattering matrix for each layer comprises the steps of:

specifying susceptance values for each frequency selective surface layer; and specifying a separation distance between each layer and each adjoining layer.

30. The method of claim 29, wherein at least one frequency selective surface layer comprises a meander line surface with a unit cell, and the step of specifying the susceptance values comprises specifying the size and shape of the unit cell.

31. The method of claim 29 wherein the desired overall response is based on a filter response for each polarization component of the electromagnetic signal and the susceptance values for each frequency selective surface layer and the separation distances are specified based on the filter response for each polarization component.

32. The method of claim 28, wherein the port I mode decoupling angle of at least one frequency selective surface layer is equal to the port II mode decoupling angle of said at least one frequency selective surface layer.

33. The method of claim 32 wherein the at least one frequency selective surface layer comprises a pattern that is invariant under 180 degree rotation.

34. A frequency selective surface structure comprising a plurality of frequency selective surface layers designed using the method of claim 28.

35. The frequency selective surface structure of claim 34, wherein at least one layer of the plurality of frequency selective surface layers comprises a meander line surface layer.

36. The frequency selective surface structure of claim 34, wherein one or more frequency selective surface layers comprise a polyimide sheet coated with copper with an etched meander line pattern.

37. The frequency selective surface structure of claim 34, wherein the polyimide sheet is disposed between an inner concentric aluminum ring and an outer concentric aluminum ring.

38. The frequency selective surface structure of claim 34, wherein at least one frequency selective surface layer comprises a polyimide sheet coated with copper with an etched meander line pattern, the polyimide sheet disposed between two concentric aluminum rings and the frequency selective surface layers being spaced apart by precision spacers.

39. The frequency selective surface structure of claim 34, wherein the rotational orientation of at least one layer is changeable.

40. The frequency selective surface structure of claim 34, wherein at least one frequency selective surface layer comprises one or more periodic metal patterns.

41. The frequency selective surface structure of claim 40, wherein at least one metal pattern of the one or more periodic metal patterns has a length greater than five wavelengths of the electromagnetic signal.

42. The frequency selective surface structure of claim 40, wherein at least one metal pattern of the one or more periodic metal patterns has a thickness less than one-twentieth of the period of the at least one metal pattern.

43. The frequency selective surface structure of claim 40, wherein at least one metal pattern of the one or more periodic metal patterns has a period of less than one-half wavelength of the electromagnetic signal.

* * * * *